US011819863B2

(12) United States Patent
Svendsen

(10) Patent No.: US 11,819,863 B2
(45) Date of Patent: Nov. 21, 2023

(54) PAINT SPRAYER SADDLE SEAL INSERTION TOOL AND METHOD

(71) Applicant: Harbor Freight Tools USA, Inc., Calabasas, CA (US)

(72) Inventor: John Michael Svendsen, Camarillo, CA (US)

(73) Assignee: HARBOR FREIGHT TOOLS USA, INC., Calabasas, CA (US)

( * ) Notice: Subject to any disclaimer, the term of this patent is extended or adjusted under 35 U.S.C. 154(b) by 0 days.

(21) Appl. No.: 17/953,071

(22) Filed: Sep. 26, 2022

(65) Prior Publication Data

US 2023/0012139 A1 Jan. 12, 2023

Related U.S. Application Data

(63) Continuation of application No. 16/815,892, filed on Mar. 11, 2020, now abandoned.

(51) Int. Cl.
*B05B 9/01* (2006.01)
*B05B 15/534* (2018.01)

(52) U.S. Cl.
CPC ..... *B05B 15/534* (2018.02); *B05B 9/01* (2013.01)

(58) Field of Classification Search
CPC ..... B05B 9/01; B05B 15/34; B05B 12/1454; B05B 7/02; B05B 15/16; B05B 15/00; B05B 15/65; B05B 11/0005
USPC ..... 239/104
See application file for complete search history.

(56) References Cited

U.S. PATENT DOCUMENTS

| | | | | |
|---|---|---|---|---|
| 3,685,126 | A | 8/1972 | Kane | |
| 4,830,281 | A | 5/1989 | Calder | |
| 4,971,249 | A | 11/1990 | Tam et al. | |
| 5,765,753 | A | 6/1998 | Kieffer | |
| 5,887,793 | A | 3/1999 | Kieffer | |
| 5,893,522 | A | 4/1999 | Kieffer | |
| 5,947,381 | A | 9/1999 | Carey | |
| 6,264,115 | B1 | 7/2001 | Liska et al. | |
| 6,390,386 | B2 | 5/2002 | Krohn et al. | |
| 6,481,640 | B1 | 11/2002 | Carey et al. | |
| 6,702,198 | B2 | 3/2004 | Tam et al. | |
| 6,978,944 | B1 * | 12/2005 | Carey | B05B 15/534 29/467 |
| D666,274 | S | 8/2012 | Smith | |
| 9,079,196 | B2 | 7/2015 | Sandahl et al. | |
| 2018/0169692 | A1 | 7/2018 | Olson et al. | |

(Continued)

*Primary Examiner* — Christopher R Dandridge
(74) *Attorney, Agent, or Firm* — McAndrews Held & Malloy, Ltd.

(57) ABSTRACT

A reversible paint spray tip, including a barrel portion configured to be inserted into a barrel bore of a tip holder, and a tip flag portion attached to the barrel portion and positioned generally transversely of the barrel portion. The tip flag portion includes a handle portion defining a handle axis, integrally formed with a first end of the tip flag portion, and an alignment portion defining an alignment axis, integrally formed with a second and opposing end of the tip flag portion. The handle axis and the alignment axis are non-collinear and intersect at an angle relative to the handle portion to prevent interference of the handle portion and barrel portion with one or more guards of the tip holder when the alignment portion is positioned in the barrel bore while in an alignment position.

3 Claims, 15 Drawing Sheets

(56) References Cited

U.S. PATENT DOCUMENTS

| | | | |
|---|---|---|---|
| 2018/0178228 | A1 | 7/2018 | Kinne et al. |
| 2019/0283054 | A1 | 9/2019 | Rossner et al. |

* cited by examiner

PAINT SPRAYER SADDLE SEAL INSERTION TOOL AND METHOD

CROSS REFERENCE TO RELATED APPLICATIONS

This application is a continuation of, and claims priority to, U.S. patent application Ser. No. 16/815,892 filed on Mar. 11, 2020, which is herein incorporated by reference in its entirety.

BACKGROUND

The present disclosure relates generally to reversible paint spray tips for airless paint sprayers.

It may be desirable to provide a spray tip flag that may be used to (1) insert a saddle seal into a spray tip holder and (2) align the inserted saddle seal so that a barrel including a spray nozzle to a reversible paint spray tip may be inserted in to the tip holder. It may be further desirable to eliminate the need for visual alignment of the saddle seal once it is inserted into the tip holder. Additionally, it may be desirable to implement the alignment tool into the part of the tip assembly to avoid misplacing the tool. Finally, it may be desirable to provide a cost effective tool that is easy to manufacture, thereby not increasing the overall cost of the reversible tip assembly.

Reversible tip assemblies for airless paint spraying typically have a saddle seal sealing the barrel in a tip holder on the front of a high pressure airless paint spray gun. Such assemblies require the removal and reinstallation or replacement of the saddle seal frequently for cleaning and to maintain a leak-free assembly. In the past, it was difficult to install the saddle seal and washer because of the limited accessibility of the interior of the housing for the tip holder. It was necessary to repeatedly install and visually align and the saddle seal because of the inability to conveniently guide the saddle seal and washer into the aligned position where the longitudinal bore and barrel bore of the tip holder intersect.

Prior techniques to solve this problem have proved inefficient or costly. For example placing the saddle seal on a tapered rod-like object was inefficient because the saddle seal was not held in alignment and could shift during insertion. As a result, visual inspection and alignment correction was necessary. Another attempt to solve this problem included machining a projection on the end of the barrel to hold the saddle seal. Such approaches however, were expensive to manufacture, because of the metal machining step required to obtain this projection, and required the additional step of visual inspection and alignment. Another attempt to solve this problem included a tool including stepped boss or other holding portion that can firmly hold and rotate the saddle seal during insertion. Such tools however, required visual alignment and correction if the saddle seal came out of alignment when the tool was withdrawn after insertion.

Thus, it may be desirable to provide a cost effective tip flag that includes an alignment tool enabling an efficient insertion and alignment of the saddle seal and thereby eliminating the need for visual alignment.

SUMMARY

A reversible paint spray tip is disclosed, substantially as illustrated by and described in connection with at least one of the figures, as set forth more completely in the claims.

Specifically, disclosed is an example reversible paint spray tip. The reversible paint spray tip may include a barrel portion configured to be inserted into a barrel bore of a tip holder. The reversible paint spray tip may also include a tip flag portion attached to the barrel portion and positioned generally transversely of the barrel portion. The tip flag portion may include a handle portion integrally formed with a first end of the tip flag portion and defining a handle axis. The tip flag portion may also include an alignment portion integrally formed with a second and opposing end of the tip flag portion and defining an alignment axis. The handle axis and the alignment axis may be non-collinear and intersect at an angle relative to the handle portion to prevent interference of the handle portion and barrel portion with one or more guards of the tip holder when the alignment portion is positioned in the barrel bore while in an alignment position.

In one example, the alignment portion may include a saddle seal retaining portion integrally formed on an end of the alignment portion configured to removably retain a saddle seal. In another example, the saddle seal retaining portion may comprise a diameter conforming to a diameter of a bore in the saddle seal. The diameter of the saddle seal retaining portion and the diameter of the bore in the saddle seal may be sized to provide a friction fit. In another example, the saddle seal retaining portion may comprise a diameter conforming to an internal diameter of a washer attached to the saddle seal.

In one example, alignment portion may include a tapered portion extending from the saddle seal retaining portion. The tapered portion may taper the alignment portion to a width conforming to a diameter of the barrel bore of the tip holder. In another example, the reversible paint spray tip is rotatable without interfering with any part of the tip holder while the alignment portion is positioned in the barrel bore while in the alignment position. In an additional example, the tip flag portion comprises a polymer. In one example, the angle relative to the handle portion is between 20 and 40 degrees. In another example, the angle relative to the handle portion is 30 degrees.

Also disclosed is an example paint spray tip assembly. The assembly may include a tip holder including a longitudinal bore and a transverse bore. The tip holder may be configured to receive a saddle seal in the longitudinal bore and a reversible paint spray tip in the transverse bore. The reversible paint spray tip may include a saddle seal retaining portion configured to removably retain the saddle seal, such that the saddle seal retaining portion is configured to be inserted into the longitudinal bore of the tip holder whereby the saddle seal is retained in the tip holder and detaches from the saddle seal retaining portion. The reversible paint spray tip may also include a barrel portion including spray tip, wherein the saddle seal retaining portion defines an alignment axis and the barrel portion defines a barrel axis. The alignment axis and the barrel axis may be non-collinear, and the barrel portion may be configured to be inserted into the transverse bore of the tip holder. The reversible paint spray tip may also include an alignment portion configured to be inserted into the transverse bore of the tip holder and adjust a position of the saddle seal when the saddle seal is retained in the longitudinal bore of the tip holder.

In one example, the saddle seal retaining portion and the alignment portion are integrally formed and comprise the alignment axis. In another example, the saddle seal retaining portion comprises a diameter conforming to a diameter of a bore in the saddle seal. In an additional example, the alignment portion may include a tapered portion, wherein the tapered portion tapers the alignment portion to a width conforming to a diameter of the transverse bore of the tip holder. In another example, the alignment portion is configured to adjust the position of the saddle seal by rotating the tapered portion within the transverse bore of the tip holder.

In one example, the alignment axis of the saddle seal retaining portion and the barrel axis of the barrel portion have a difference in orientation that is sufficient to prevent interference of any part of the reversible paint spray tip with any part of the tip holder. In another example, the difference in orientation of the alignment axis of saddle seal retaining portion and the barrel axis of the barrel portion is between 110 and 130 degrees.

Also disclosed is an example method for installing a saddle seal in a paint sprayer tip holder with a tip flag portion of a reversible paint spray tip wherein the tip flag portion includes a handle portion and an alignment portion. One step of the example method may include positioning a saddle seal on the alignment portion by inserting a saddle seal retaining portion integrally formed on an end of the alignment portion into a bore in the saddle seal. Another step of the example method may include inserting the saddle seal in a longitudinal bore of the tip holder. Another step of the example method may include withdrawing the tip flag portion from the longitudinal bore of the tip holder, while the saddle seal remains in the tip holder. Another step of the example method may include inserting the alignment portion of the tip flag portion into a transverse barrel bore of the tip holder until at least a portion of the alignment portion contacts at least a portion of the saddle seal. Another step of the example method may include aligning the saddle seal by moving the alignment portion within the transverse barrel bore of the tip holder. Another step of the example method may in include withdrawing the tip flag portion from the transverse barrel bore once the alignment portion has been fully inserted into the transverse barrel bore and the saddle seal has been aligned.

The example method may also include the step of inserting a barrel portion of the reversible paint spray tip into the transverse barrel bore of the tip holder. The example method may also include the step of aligning the longitudinal bore of the tip holder with a longitudinal bore of a spray gun. The example method may also include the step of attaching the tip holder to the spray gun by screwing an attachment portion of the tip holder onto threads of the spray gun.

Figure 1:
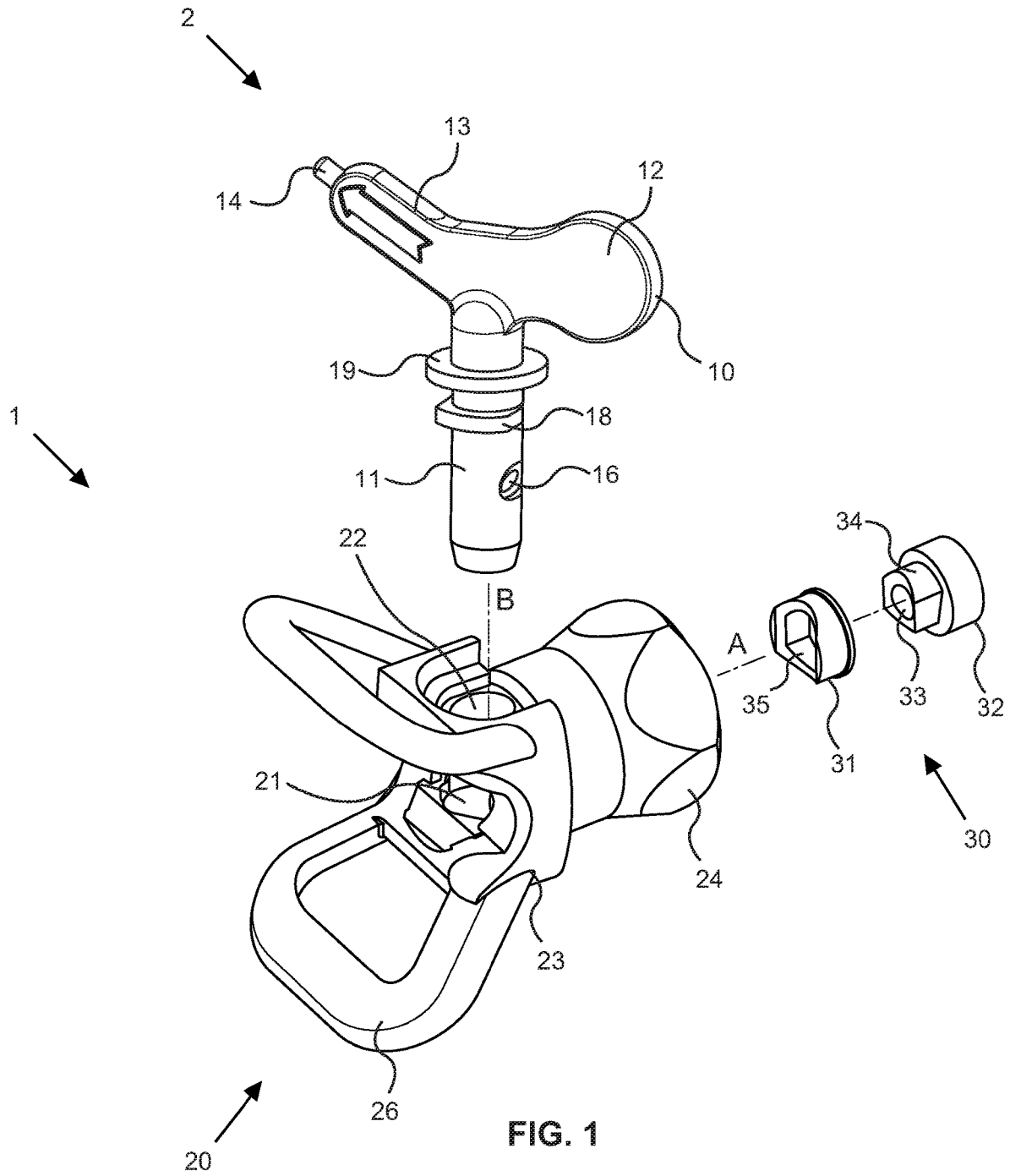
FIG. 1 is perspective exploded view of a paint spray tip assembly having a reversible paint spray tip having a tip flag, a tip holder, and a saddle seal, in accordance with aspects of this disclosure.
Figure 2:
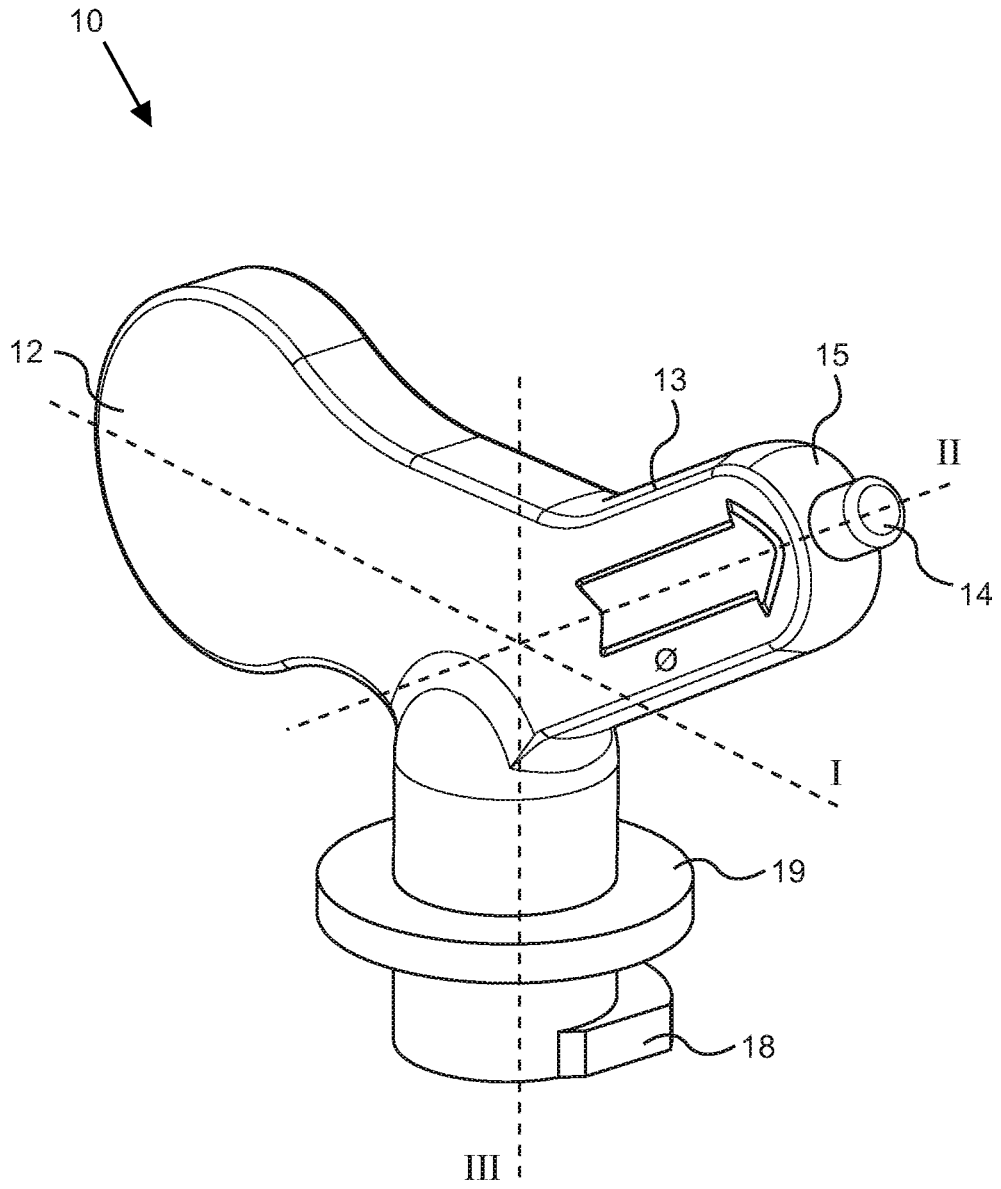
FIG. 2 is a perspective view of the tip flag, in accordance with aspects of this disclosure.
Figure 3:
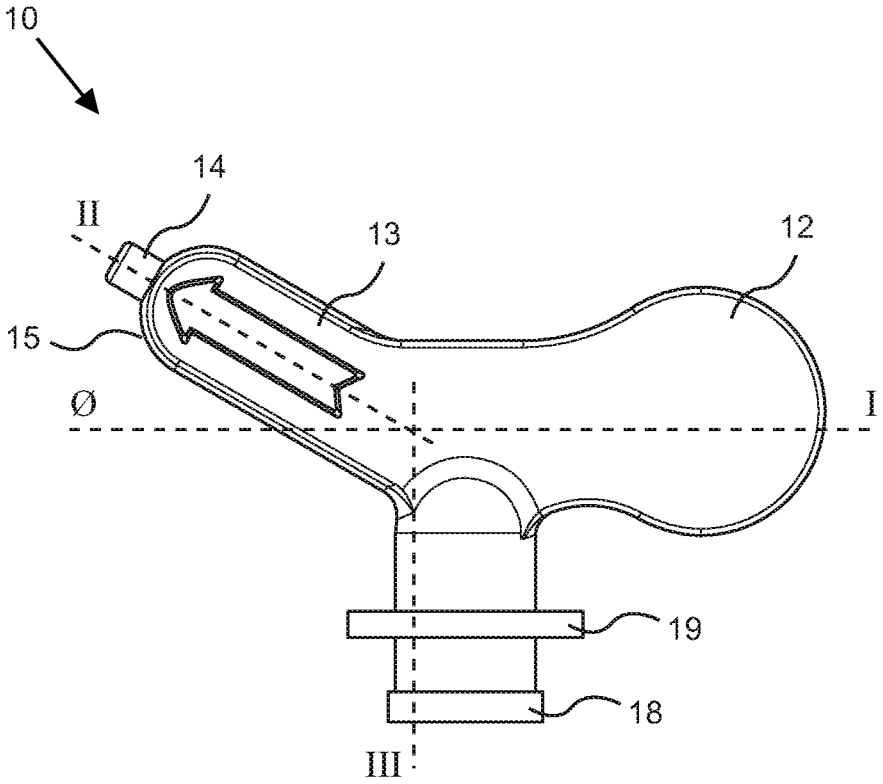
FIG. 3 is a front elevation view of the tip flag, in accordance with aspects of this disclosure.
Figure 4:
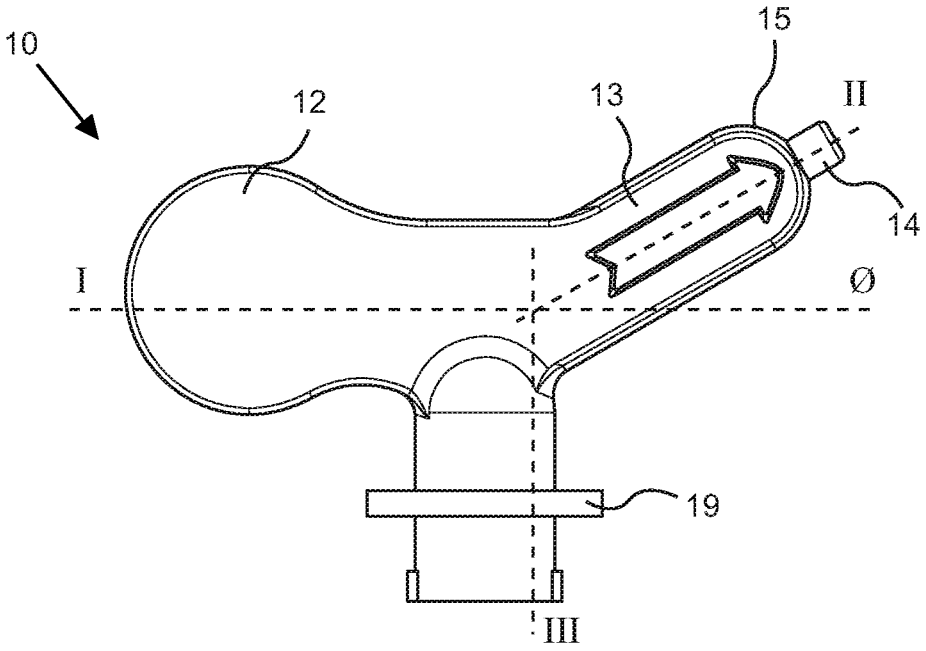
FIG. 4 is a rear elevation view of the tip flag, in accordance with aspects of this disclosure.
Figure 5:
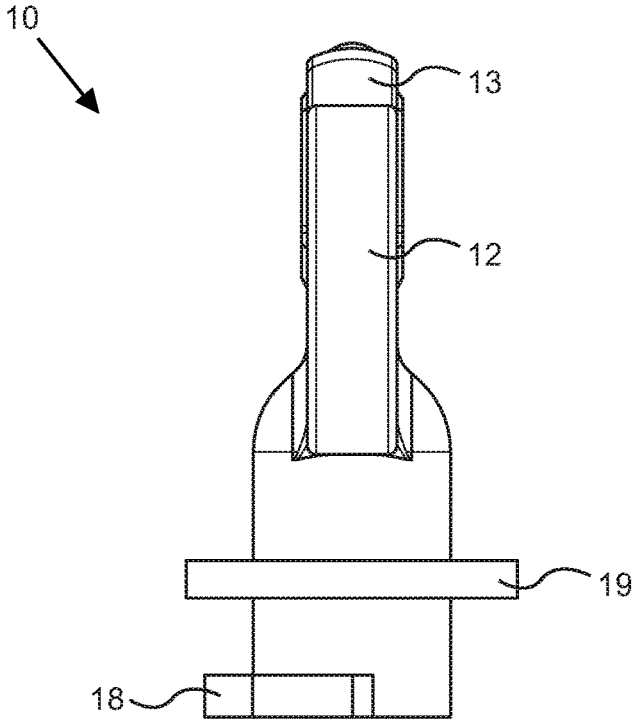
FIG. 5 is a left side elevation view of the tip flag, in accordance with aspects of this disclosure.
Figure 6:
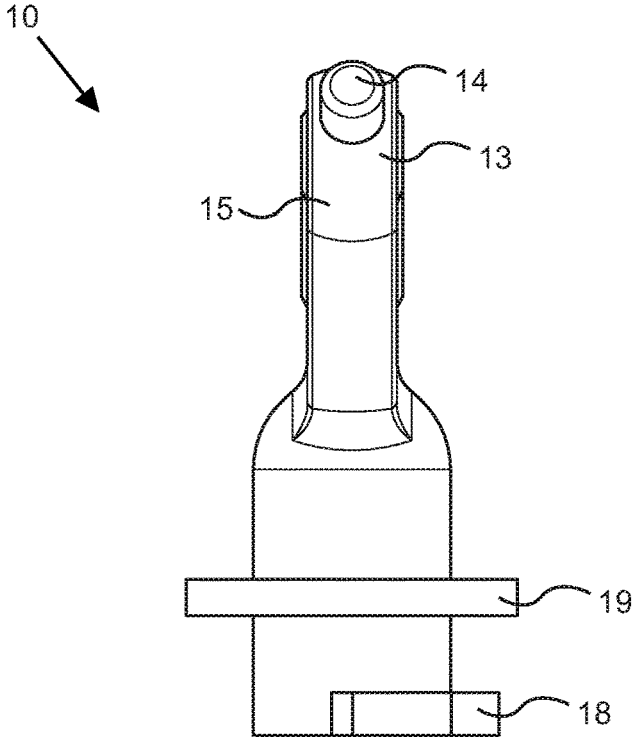
FIG. 6 is a right side elevation view of the tip flag, in accordance with aspects of this disclosure.
Figure 7:
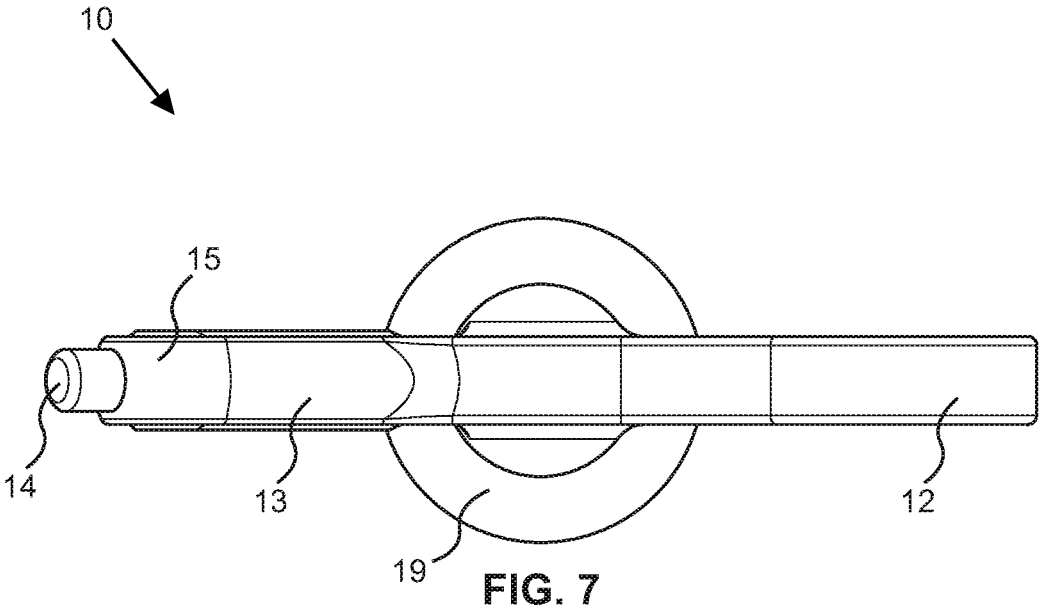
FIG. 7 is a top plan view of the tip flag, in accordance with aspects of this disclosure.
Figure 8:
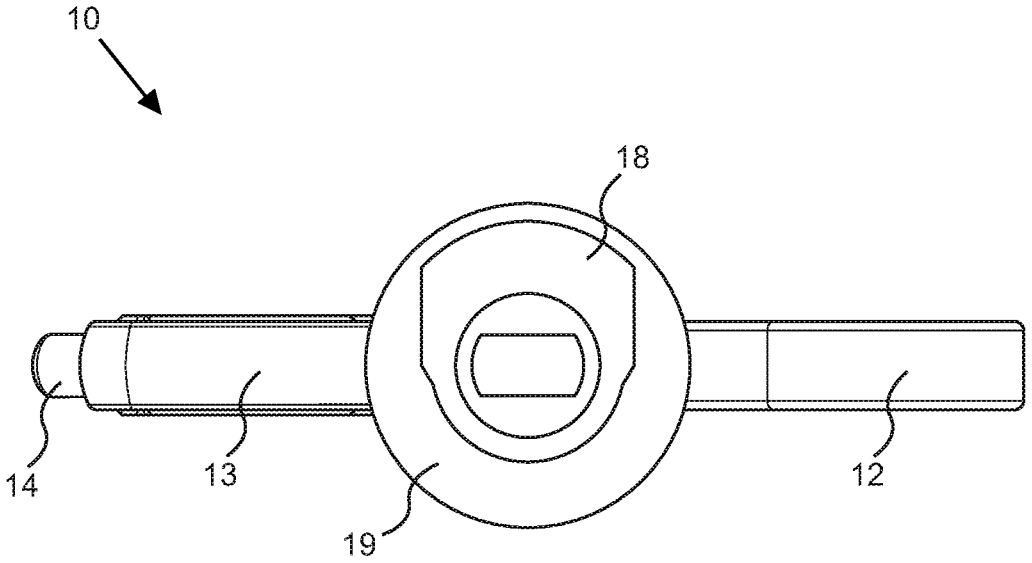
FIG. 8 is a bottom plan view of the tip flag, in accordance with aspects of this disclosure.
Figure 9:
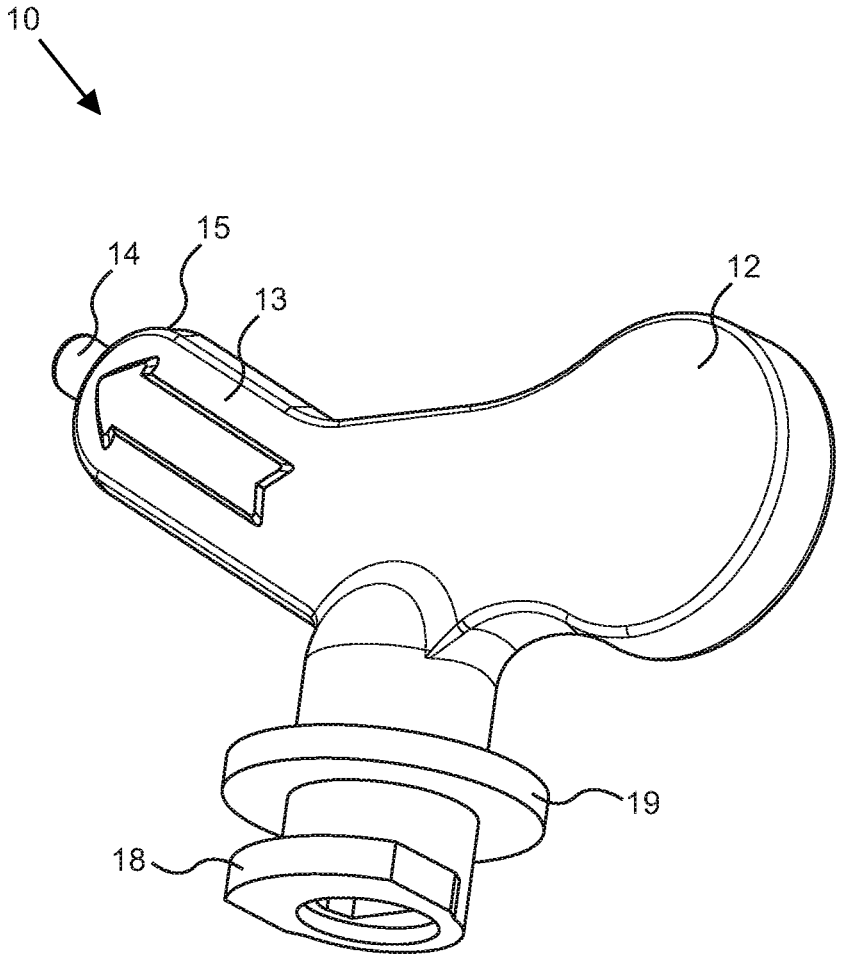
FIG. 9 is another perspective view of the tip flag, in accordance with aspects of this disclosure.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

Parts Listing:

| Number | Description |
|---|---|
| 1 | Paint spray tip assembly |
| 2 | Reversible paint spray tip |
| 10 | Tip flag |
| 11 | Barrel portion |
| 12 | Handle portion |
| 13 | Alignment portion |
| 14 | Saddle seal retaining portion |

-continued

| Parts Listing: | |
|---|---|
| Number | Description |
| 15 | Tapered portion |
| 16 | Diffuser |
| 17 | Spray tip |
| 18 | Locking tab |
| 19 | Shield |
| 20 | Tip holder |
| 21 | Longitudinal bore |
| 22 | Transverse barrel bore |
| 23 | Barrel receiving portion |
| 24 | Attachment portion |
| 25 | Connecting portion |
| 26 | Guard |
| 27 | threads |
| 30 | Saddle seal |
| 31 | Saddle portion |
| 32 | Sealing portion |
| 33 | Seal bore |
| 34 | Extended portion |
| 35 | Saddle bore |
| A | Longitudinal axis |
| B | Transverse axis |
| I | Alignment axis |
| II | Handle axis |
| III | Barrel axis |
| Ø | Angle between alignment axis and handle axis |

FIG. 1 shows an exploded view of an example paint spray tip assembly 1. The paint spray tip assembly 1 may generally include a reversible paint spray tip 2 having tip flag portion 10 ("tip flag"), a paint sprayer tip holder 20 ("tip holder"), and a saddle seal 30.

In one embodiment, the reversible paint spray tip 2 also includes a barrel portion 11 ("barrel") attached to the tip flag 10. The tip flag 10 may include a handle portion 12 and an alignment portion 13. The Alignment portion 13 may include a saddle seal retaining portion 14, configured to removably retain the saddle seal 30. In one embodiment, a tapered portion 15 may extend from saddle seal retaining portion 14, tapering the alignment portion 13 to a width conforming to a diameter of a barrel bore 22 of the tip holder 20, such that the alignment portion 13 can be inserted into the barrel bore 22. The tapered portion 15 may assist in adjusting the position of the saddle seal 30 during the alignment process by catching an edge of the saddle seal 30 and rotating the saddle seal 30 into the properly seated position as the alignment portion 13 is pushed further into the barrel bore 22.

The barrel 11 may include a diffuser 16 and a spray tip 17. The diffuser 16 and spray tip 17 may be positioned on the barrel 11 to align with a longitudinal axis A (and longitudinal bore 21) of the tip holder 20 when the barrel 11 is inserted into the tip holder 20. The tip flag 10 may also include a locking tab 18 for locking the orientation of the tip flag 10. In one embodiment, the barrel 11 may be rotated in tip holder 20 by grasping and rotating the handle portion 12, to move the tip flag 10 (and thereby the entire reversible paint spray tip 2) between a spraying position and a cleaning position. The tip flag 10 may also include a shield 19, for shielding paint spray. In one embodiment, the handle portion 12 and the alignment portion 13 are integrally formed into a single part (i.e., the tip flag 10) and may be formed of a polymer. The use of a polymer may contribute to a cost effective manufacturing as it does not require expensive metal machining. The barrel 11 may be formed of metal.

In one embodiment, the tip holder 20 includes longitudinal bore 21 along a longitudinal axis A and a transverse bore 22 ("barrel bore") along a transverse axis B. The longitudinal bore 21 and barrel bore 22 may intersect allowing communication between longitudinal bore 21 and the barrel bore 22. The tip holder 20 may further include a barrel receiving portion 23 and an attachment portion 24, connected to the barrel receiving portion 23, by a connecting portion 25. In one example, the barrel bore 22 is disposed at the barrel receiving portion 23. The tip holder 20 may also include one or more guards 26 extending from the tip holder 20. The guards 26, may assist in preventing an obstruction of the longitudinal bore 21 and spray tip 17 when the reversible paint spray tip 2 is inserted into the tip holder 20.

The barrel receiving portion 23 may be configured to receive a barrel 11 of a reversible paint spray tip 2. For example, the barrel 11 may be inserted into the barrel bore 22. The attachment portion 24 may be configured to attach the tip holder 20 to an airless paint sprayer (not shown). For example the attachment portion 24 may be a nut comprising internal threads 27 that engage with corresponding threads on the airless paint sprayer. In such an example, the tip holder 20 may be attached to the paint sprayer by screwing attachment portion 24 (e.g., nut) onto the threads of the spray gun. The connection portion 25 may comprise a collar or any other means of connection allowing independent respective rotation of the barrel receiving portion 23 and the attachment portion 24. In one embodiment, the tip holder 20 is formed primarily or entirely of metal. In another embodiment, a portion of the tip holder 20 including the guards 26 are formed of a polymer.

In one embodiment, the saddle seal 30 may include a saddle portion 31 and a sealing portion 32. The sealing portion 32 may include a seal bore 33 and an extended portion 34. The saddle portion 31 may include a saddle bore 35, configure to receive the extended portion 34. In one embodiment, the extended portion 34 extends beyond the saddle portion 31 when the sealing portion 32 is connected to the saddle portion (i.e., the assembled saddle seal). In such an embodiment the extended portion 34 forms the seal against the barrel 11 when the barrel 11 is installed into the tip holder. In another embodiment the sealing portion 32 is formed of a polymer and the saddle portion 31 is formed of metal. The present disclosure contemplates other variations of saddle seals including saddle seals using elastomer washers.

FIGS. 2-9 show an example tip flag 10 including a handle portion 12 an alignment portion 13, a saddle seal retaining portion 14, a tapered portion 15, a locking tab 18, and a shield 19. In one embodiment, the handle portion 12 is integrally formed with a first end of the tip flag portion and defines a handle axis I. In such an embodiment, the alignment portion 13 may be integrally formed with a second and opposing end of the tip flag portion and define an alignment axis II. The barrel 11 (not shown in FIGS. 2-9) may further define a barrel axis III.

In a preferred embodiment, the handle axis I and the alignment axis II are non-collinear and intersect at an angle Θ relative to the handle portion 12 to prevent interference of the handle portion 12 and barrel portion 11 with one or more guards 26 of the tip holder 20 when the alignment portion 13 is positioned in the barrel bore 22 while in an alignment position. Likewise, the angle Θ relative to the handle portion 12 may prevent interference of the handle portion 12 and barrel portion 11 with one or more guards 26 of the tip holder 20 when the barrel 11 is inserted into the barrel bore 22 in an operation position. For example, the angle Θ relative to the handle portion may be between 20 and 40 degrees, or preferably 30 degrees.

Similarly, the difference in orientation between the alignment axis I and the barrel axis III may be sufficient to prevent interference of any part of the reversible paint spray tip 2 with any part of the tip holder 20 when then alignment portion 13 is inserted into the barrel bore 22 while in an alignment position or the barrel is inserted into the barrel bore 22 in an operation position. In on example, the difference in orientation between the alignment axis I and the barrel axis III may be between 110 and 130 degrees. Preventing interference between any portion of the tip flag 10 and the tip holder 20 may help enable a simple non-visual alignment and smooth operation of the paint spray tip assembly 1 by allowing free rotation of the various components.

As discussed above, tip flag 10 may also include a saddle seal retaining portion 14 integrally formed with, and on an end of, the alignment portion 13. The saddle seal retaining portion 14 may be configured to removably retain, via a friction fit (i.e., the parts are sized to provide a friction fit), the saddle seal 30 when being inserted into the seal bore 33. Such an embodiment is shown for example in FIGS. 12 and 14. The saddle seal retaining portion 14 may generally comprise a rounded boss or post that has a diameter. The diameter of the saddle seal retaining portion 14 may conform to a diameter of the seal bore 33 of the saddle seal 30. Alternatively, diameter of the saddle seal retaining portion 14 may conform to an internal diameter of a washer (not shown) attached to the saddle seal 30.

Figure 16:
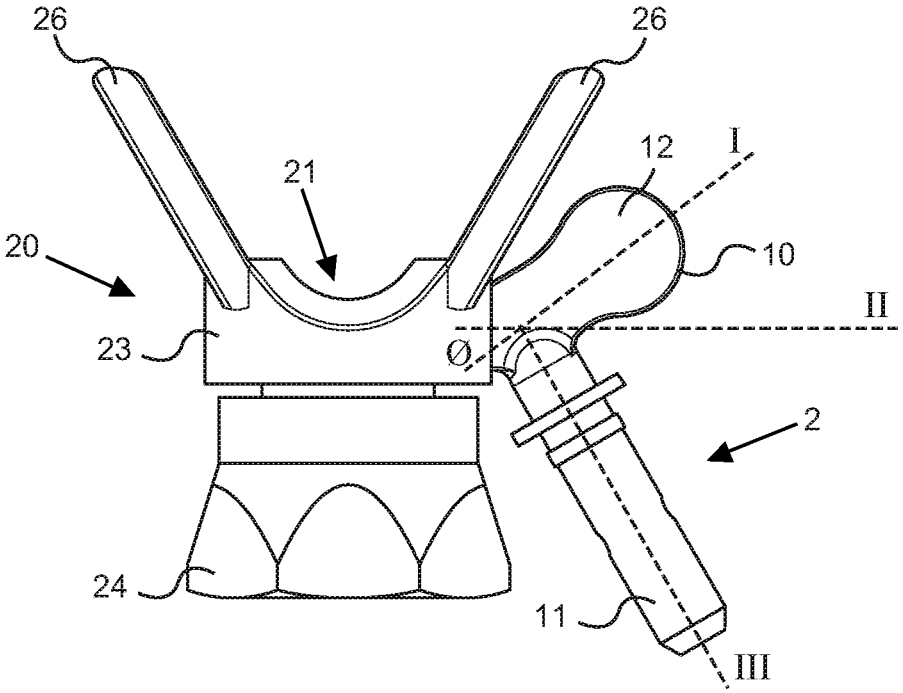
FIG. 16 is a side view of the tip holder and the tip flag in an alignment position, showing the clearance of barrel and handle with respect to the tip holder guards as a result of the intersection angle of the handle axis and alignment axis, in accordance with aspects of this disclosure.
Figure 17:
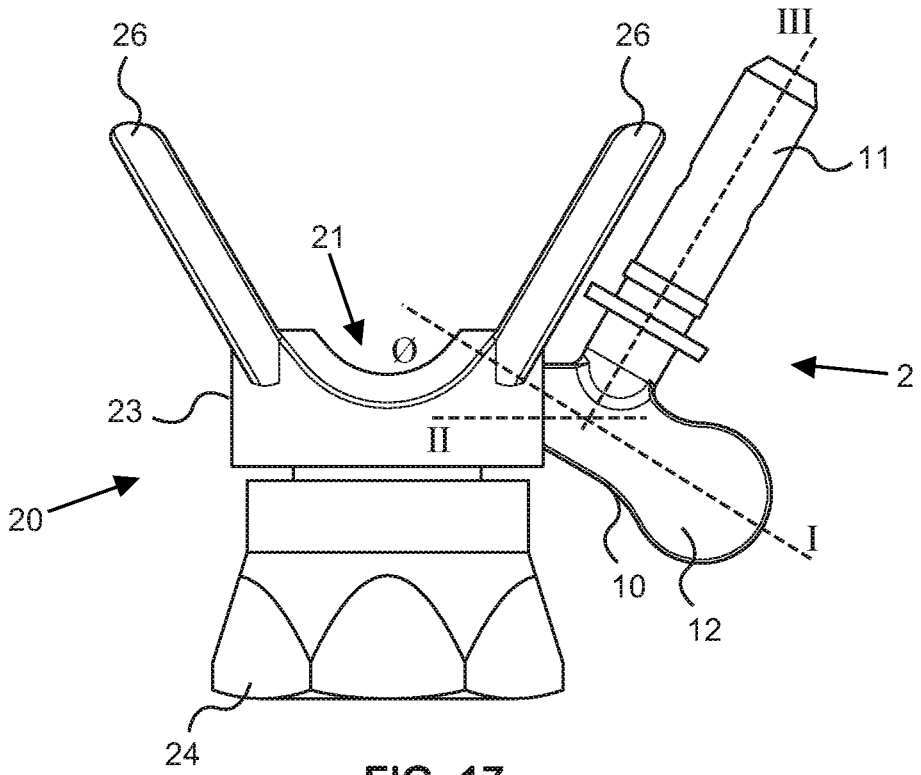
FIG. 17 is a side view of the tip holder and the tip flag in an alignment position, showing the clearance of barrel and handle with respect to the tip holder guards as a result of the intersection angle of the handle axis and alignment axis, in accordance with aspects of this disclosure.
Figure 18:
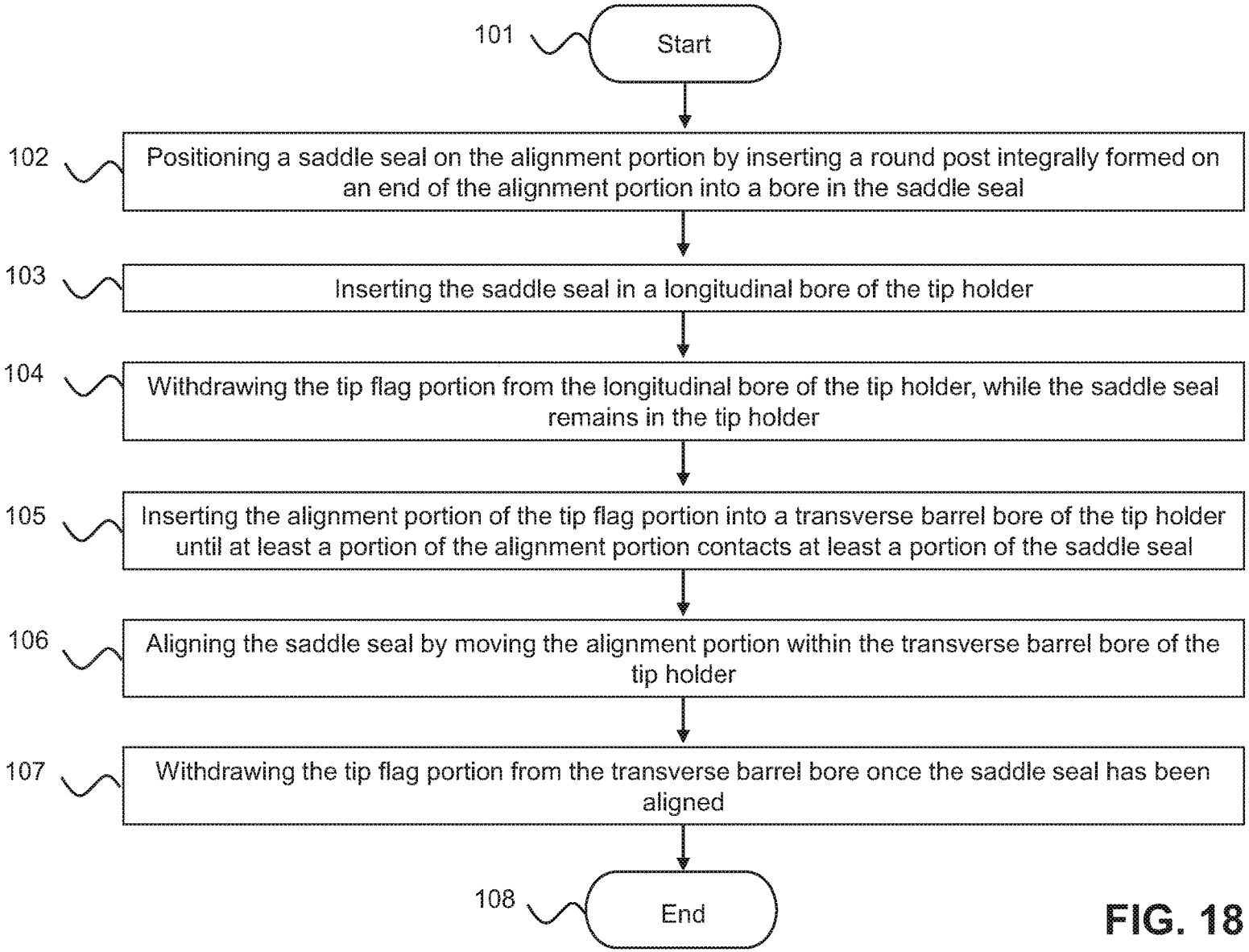
FIG. 18 is a flow chart illustrating example steps for inserting and aligning a saddle seal and washer in a paint sprayer housing using a tip flag tool, in accordance with aspects of this disclosure.

FIGS. 12-18 show an exemplary way to use the tip flag 10 of a reversible paint spray tip 2 to install the saddle seal 30 into the tip holder 20. FIG. 18 is a flow chart illustrating example steps for installing a saddle seal 30 in a tip holder 20 with a tip flag portion 10 of a reversible paint spray tip 2. In such an example the tip flag 10 includes a handle portion 12 and an alignment portion 13. Referring to FIG. 18, the example steps may start at step 101. At step 102, saddle seal 30 is positioned on the alignment portion 13 by inserting a saddle seal retaining portion 14 integrally formed on an end of the alignment portion 13 into a bore 33 in the saddle seal 30. At step 103, the saddle seal is inserted in a longitudinal bore 21 of the tip holder 20. At step 104, the tip flag portion 10 is withdrawn from the longitudinal bore 21 of the tip holder 20, while the saddle seal 30 remains in the tip holder 20. At step 105, the alignment portion 13 is inserted of the tip flag portion 10 into a transverse barrel bore 22 of the tip holder 20 until at least a portion of the alignment portion 13 contacts at least a portion of the saddle seal 30. At step 106, the saddle seal 30 is aligned by moving the alignment portion 14 within the transverse barrel bore 22 of the tip holder 20. At step 107, the tip flag portion 10 is withdrawn from the transverse barrel bore 22 once the alignment portion 13 has been fully inserted into the transverse barrel bore 22 and the saddle seal 30 has been aligned. The example steps may proceed to the end step 108. It is to be understood that the present disclosure is not limited to the specific order of steps 101 to 108—other orders are possible. Steps may also be performed in parallel.

Figure 10:
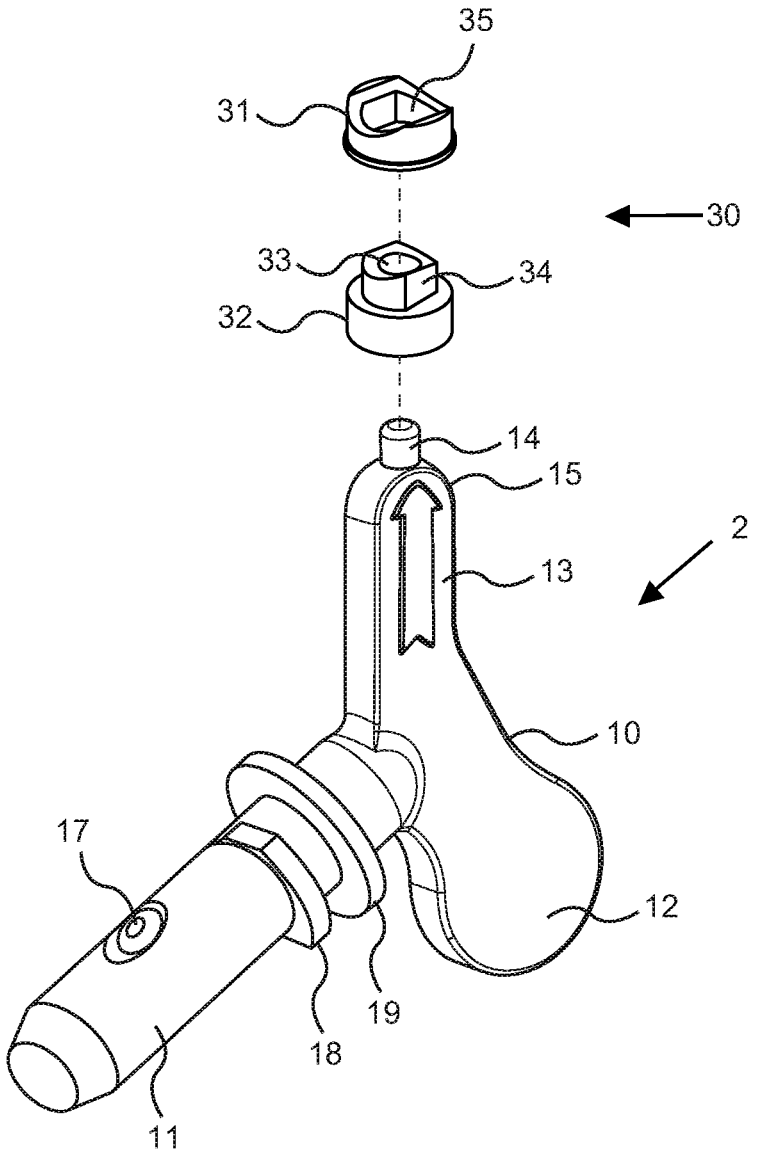
FIG. 10 is perspective exploded view of the reversible paint spray tip and saddle seal, in accordance with aspects of this disclosure.
Figure 11:
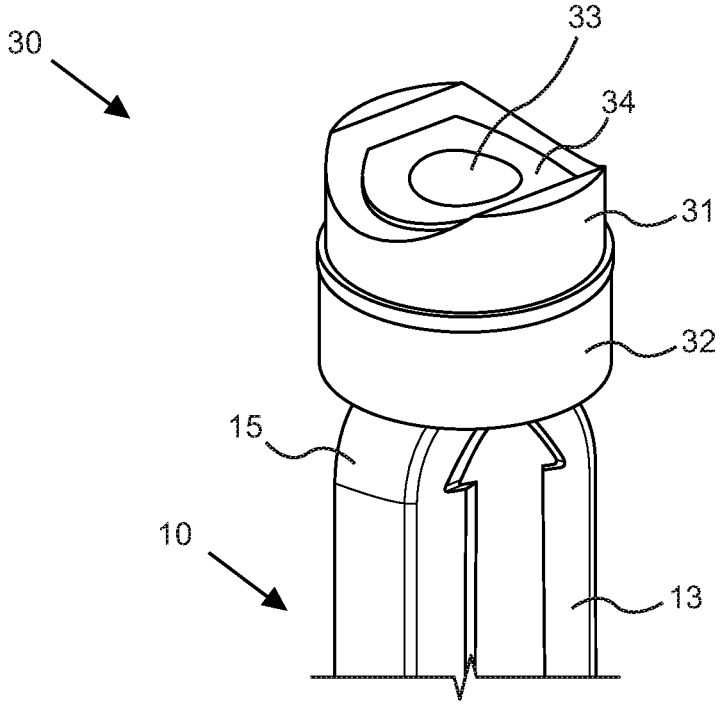
FIG. 11 is an enlarged fragmentary perspective view of the tip flag with the saddle seal received on the saddle seal retaining portion for installation of the saddle seal into the tip holder, in accordance with aspects of this disclosure.

Step 102, is illustrated for example in FIGS. 10 and 11. Specifically, FIG. 10 shows the alignment of the saddle seal retaining portion 14 with the seal bore 33 of the saddle seal 30. As discussed above, the saddle seal 30 may be retained on the saddle seal retaining portion 14 via a friction fit. FIG. 11 shows a close-up of the saddle seal 30 retained on the saddle seal retaining portion 14, ready for insertion into the tip holder 20. It is to be understood that the saddle seal retaining portion 14 retains the saddle seal 30 to allow rotation of the saddle seal 30 once it has been inserted into the tip holder 20.

Figure 12:
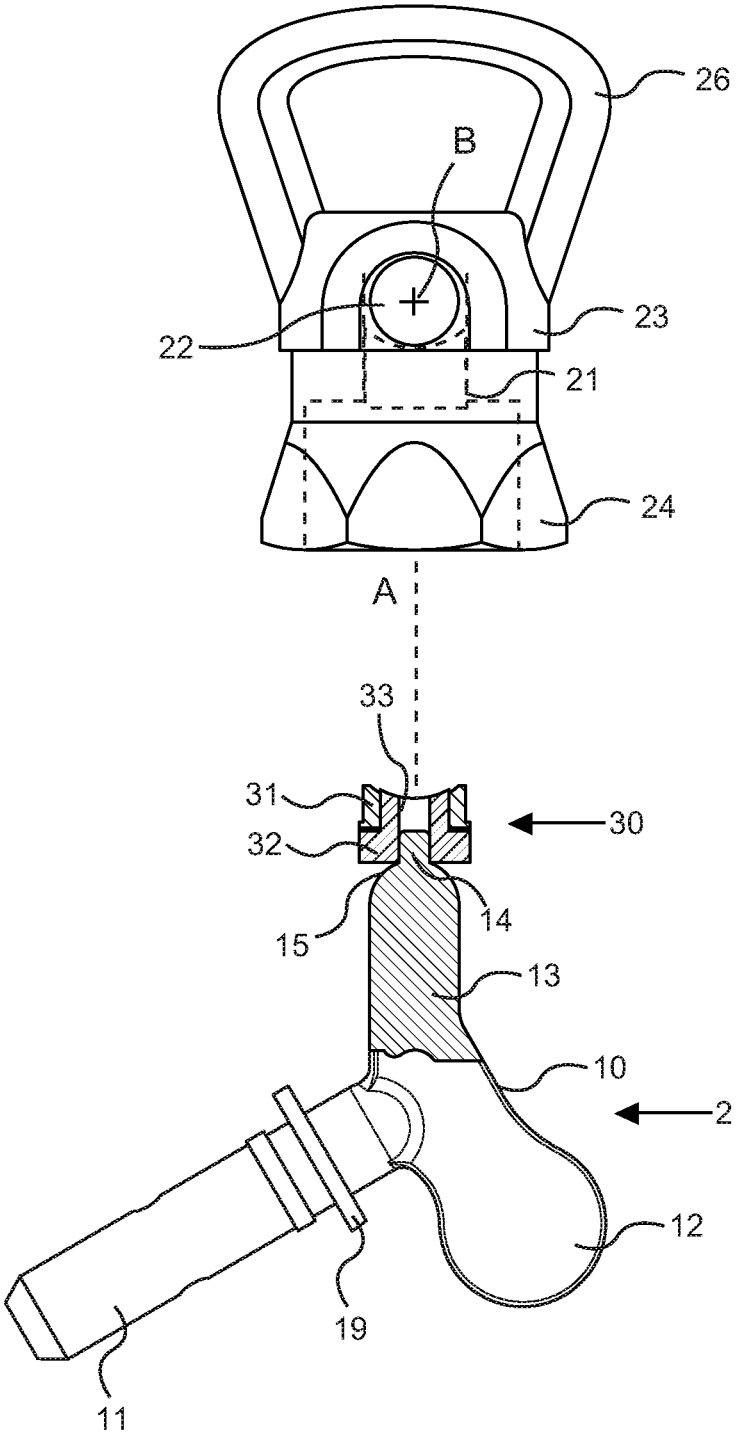
FIG. 12 is view of the tip holder with the saddle seal mounted on saddle seal retaining portion of the tip flag ready for installation of the saddle seal into the longitudinal bore of the tip holder, with the tip flag and saddle seal shown partly in section, in accordance with aspects of this disclosure.
Figure 13:
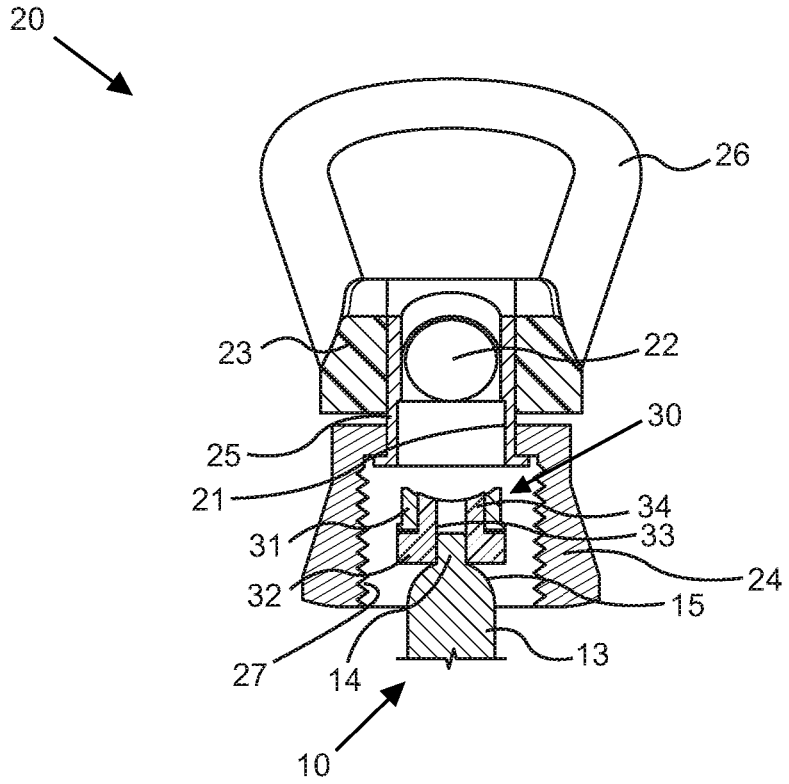
FIG. 13 is a cross-sectional side section view of tip holder and tip flag showing the parts immediately prior to installation of the saddle seal into longitudinal bore of the tip holder, in accordance with aspects of this disclosure.

Steps 103 and 104, are illustrated for example in FIGS. 12 and 13. Specifically, FIG. 12 shows the alignment of the saddle seal 30 retained on the saddle seal retaining portion 14 with the longitudinal axis A (and therefore the longitudinal bore 21) of the tip holder. FIG. 13 shows a cross sectional view of an exemplary tip holder 20 showing the internal alignment of the saddle seal 30 with the longitudinal bore 21. It is to be understood that at step 104, once the saddle seal 30 has been inserted and fully seated into the longitudinal bore 21, a friction fit between the saddle seal 30 and the longitudinal bore 21 may hold the saddle seal 30 within the longitudinal bore 21 as the tip flag 10 detaches therefrom and is withdrawn.

Figure 14:
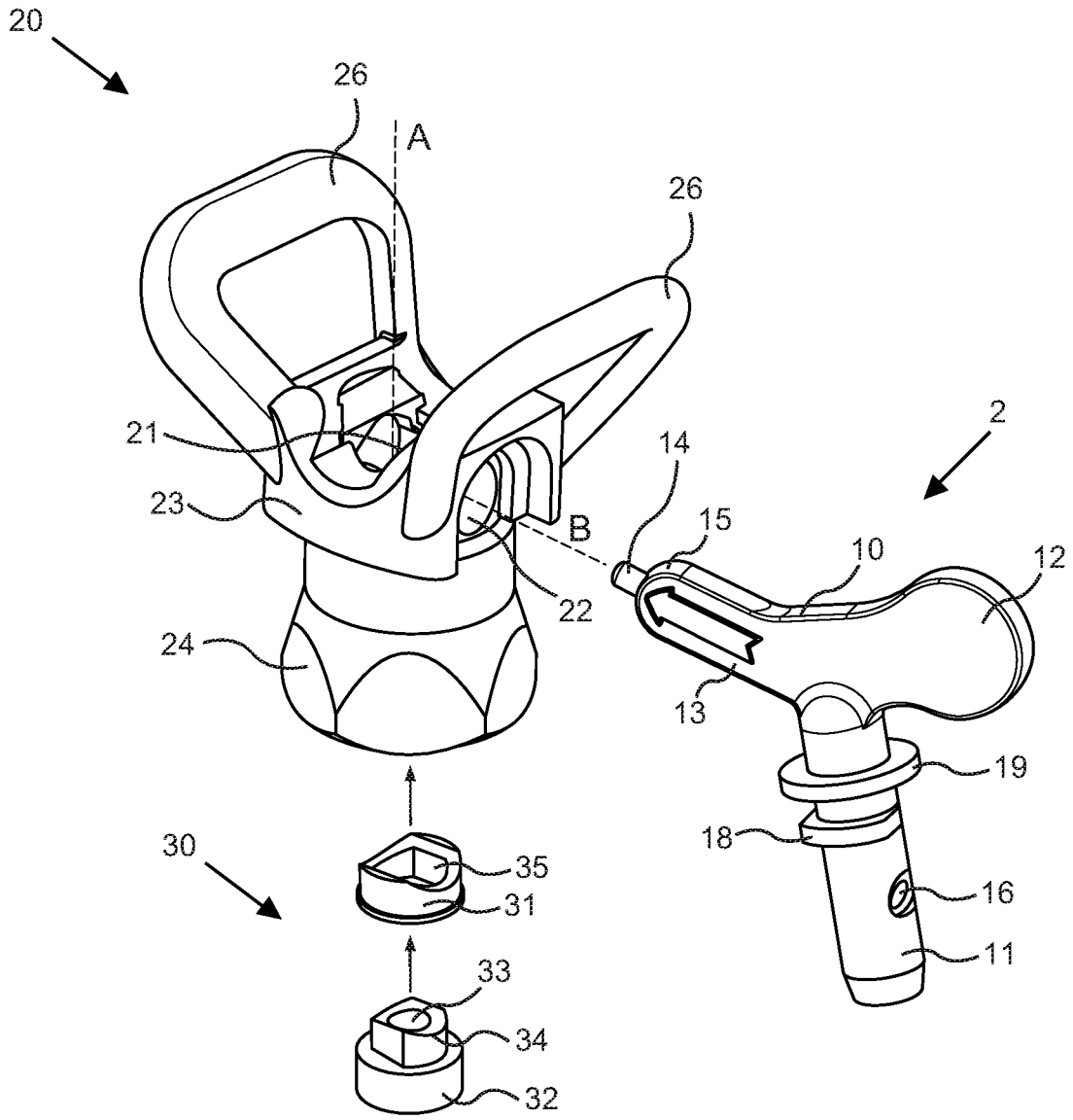
FIG. 14 is an exploded view illustrating the alignment position of the tip holder to align the saddle seal in the housing using the alignment portion of the tip flag, in accordance with aspects of this disclosure.
Figure 15:
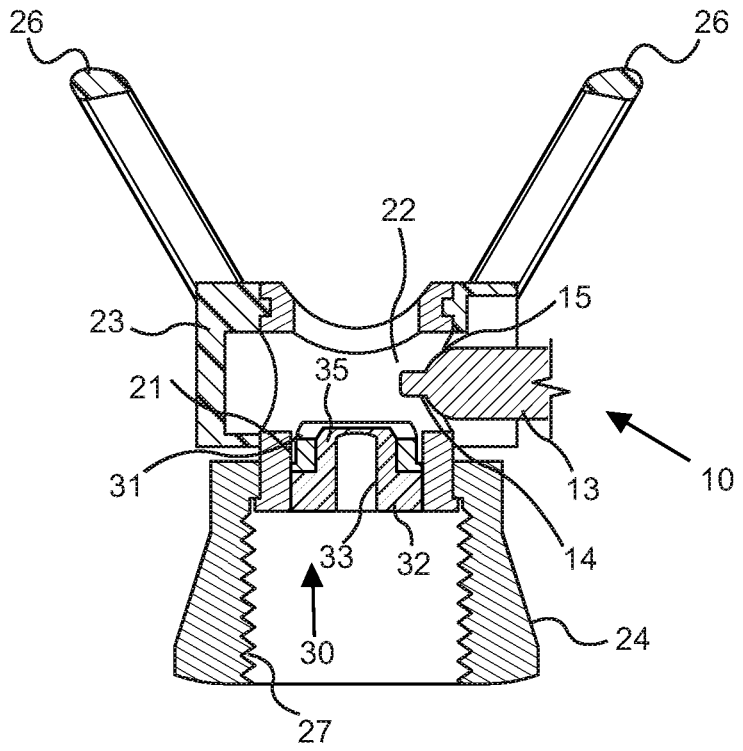
FIG. 15 is a cross-sectional view of FIG. 13 showing the alignment portion of the tip flag inserted into the barrel bore of the tip holder in an alignment position.

Steps 105, 106, and 107, are representative of the alignment position of the tip flag 10 and are illustrated for example in FIGS. 14-17. Specifically, FIG. 14 shows an exploded view of the tip holder 20 and saddle seal 30. It is to be understood, that at this step, the saddle seal 30 has already been inserted into the longitudinal bore 21. FIG. 14 also shows the alignment of the alignment portion 13 with the transverse axis B (and therefore transverse barrel bore 22) of the tip holder 20. FIG. 15, shows the alignment portion 13 partially inserted into the barrel bore 22. As was explained above, the alignment begins when at least a portion of the alignment portion 13 contacts at least a portion of the saddle seal 30.

Importantly, alignment without the need for visual inspection and correction is enabled by the tapered portion 15. After a portion the tapered portion 15 of the alignment portion contacts the saddle seal 30, a user continues to move the alignment portion 13 into the barrel bore 22. It is to be understood that the term "move" or "moving" as contemplated by this disclosure includes rotation and lateral movement. For example, as the alignment portion 13 is rotated and pushed laterally further into the barrel bore, the tapered portion 15 will catch and rotate the saddle seal 30 until the saddle seal 30 is aligned. Once the saddle seal 30 is aligned, the alignment portion 13 is able to be fully inserted into the barrel bore 22 (i.e., inserted until it either hits an opposing end of the barrel bore 22 or the entirety of the alignment portion 13 is inserted into the barrel bore 22). Visual inspection is not necessary because only after the saddle seal 30 has been aligned, will the alignment portion 13 be fully inserted into the barrel bore 22. Thus, a user will know that if the alignment portion 13 is fully inserted into the bare bore 22, that the saddle seal 30 is aligned.

Additionally, FIGS. 16 and 17 show that alignment portion 13 of the tip flag 10 (and thereby the reversible paint spray tip 2) can be fully rotated within the barrel bore 22 in the alignment position without interference of any part of the reversible paint spray tip 2 with any part of the tip holder 20. Such a clearance is enabled as a result of the angle and/or the difference in orientation of the alignment axis I, the handle axis II, and the barrel axis III as described above. Further, such full rotation may ensure that the tapered portion 15 of the alignment portion 13 can catch and align the saddle seal 30.

Once, the saddle seal 30 is aligned and the alignment portion 13 is withdrawn, the barrel 11 of the reversible paint spray tip 2 may be inserted into the barrel bore 22 and form a seal against the saddle seal 30. Finally, it is to be understood that the tip flag 10 may also be used to remove the saddle seal 30 from the tip holder 20. As discussed above, the present disclosure provides a reversible paint spray tip 2 that can be used to efficiently insert an align a saddle seal 30 into a tip holder 20, thereby eliminating the need for visual inspection.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. A method for installing a saddle seal in a paint sprayer tip holder with a tip flag portion of a reversible paint spray tip, wherein the tip flag portion includes a handle portion and an alignment portion, comprising:

positioning a saddle seal on the alignment portion by inserting a saddle seal retaining portion integrally formed on an end of the alignment portion into a bore in the saddle seal;

inserting the saddle seal in a longitudinal bore of the tip holder;

withdrawing the tip flag portion from the longitudinal bore of the tip holder, while the saddle seal remains in the tip holder;

inserting the alignment portion of the tip flag portion into a transverse barrel bore of the tip holder until at least a portion of the alignment portion contacts at least a portion of the saddle seal;

aligning the saddle seal by moving the alignment portion within the transverse barrel bore of the tip holder; and withdrawing the tip flag portion from the transverse barrel bore once the alignment portion has been fully inserted into the transverse barrel bore and the saddle seal has been aligned.

2. The method of claim 1, further comprising inserting a barrel portion of the reversible paint spray tip into the transverse barrel bore of the tip holder.

3. The method of claim 2, further comprising:

aligning the longitudinal bore of the tip holder with a longitudinal bore of a spray gun; and attaching the tip holder to the spray gun by screwing an attachment portion of the tip holder onto threads of the spray gun.

* * * * *